United States Patent [19]

Knaell

[11] 3,961,450

[45] June 8, 1976

[54] TWIST DRILL SHARPENING APPARATUS

[76] Inventor: Kenneth Kay Knaell, 307 S. Cassingham Road, Columbus, Ohio 43209

[22] Filed: Feb. 10, 1975

[21] Appl. No.: 548,822

[52] U.S. Cl. ..... 51/219 R; 51/165.72

[51] Int. Cl.[2] ..... B24B 3/26

[58] Field of Search ..... 51/219 R, 219 PC,

[56] References Cited

UNITED STATES PATENTS

| | | | |
|---|---|---|---|
| 2,040,978 | 5/1936 | Cogsdill | 51/219 R |
| 2,455,562 | 12/1948 | Crowther | 51/219 R |
| 2,821,820 | 2/1958 | Thumann | 51/221 R X |
| 3,022,609 | 2/1962 | Abadjieff | 51/219 R X |

FOREIGN PATENTS OR APPLICATIONS

| | | | |
|---|---|---|---|
| 302,991 | 1/1955 | Switzerland | 51/219 R |

*Primary Examiner*—Harold D. Whitehead
*Attorney, Agent, or Firm*—William T. Fryer, III

[57] ABSTRACT

The present invention relates to hand-held, portable twist drill sharpening devices. In the embodiment described the twist drill is placed in a holder and aligned with an optical indicating device for sharpening by a hand-held, flat surfaced sharpening stone. The holder is formed by two V-shaped clamping pieces that position the twist drill with respect to the holder apex angle and roof line. The optical indicating device includes an index member and means for positioning the index member with respect to the holder roof line at the predetermined angle for the drill cutting edge. When the index member is positioned, the twist drill cutting edge is aligned with it. The twist drill is positioned lengthwise and is already for sharpening each cutting edge without further adjustment, by moving the sharpening stone along the end faces of the clamping pieces. The optical indicating device is arranged for alignment while being hand held, or mounted on the clamping pieces to align the index member with respect to the roof line. The optical indicating device can be guided for a small distance while being separated from the holder, to maintain its alignment.

12 Claims, 12 Drawing Figures

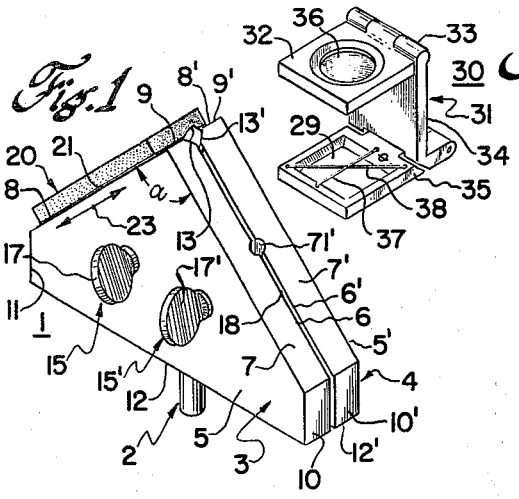
Fig. 1
Fig. 2
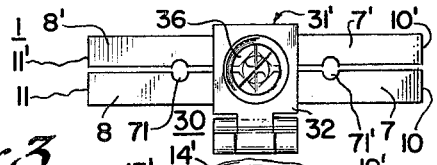
Fig. 3
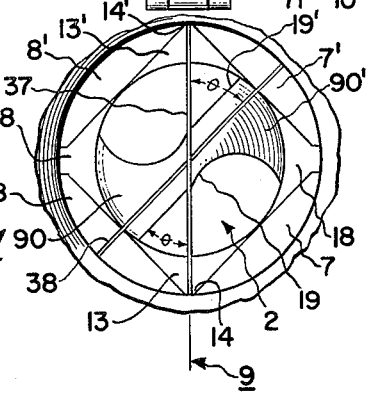
Fig. 4
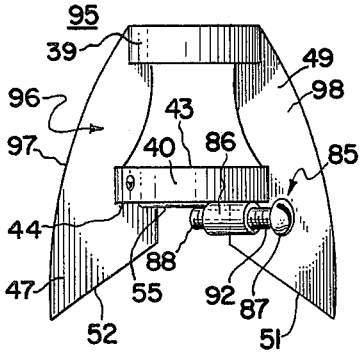
Fig. 5
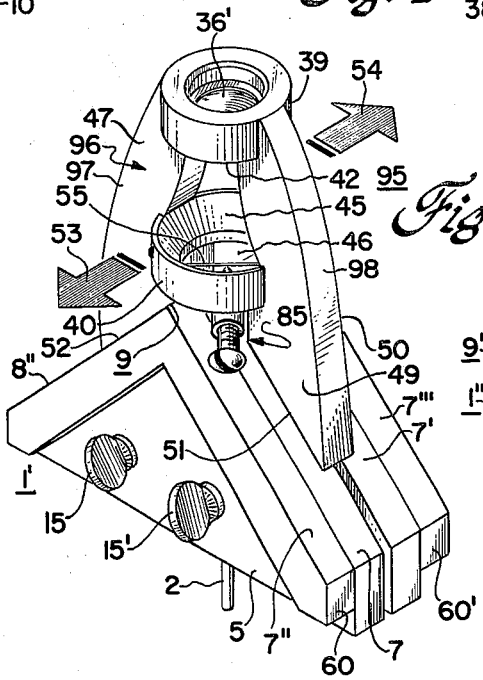
Fig. 6
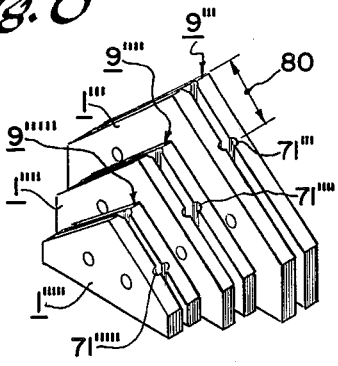
Fig. 7
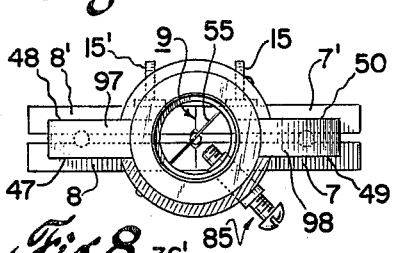
Fig. 10
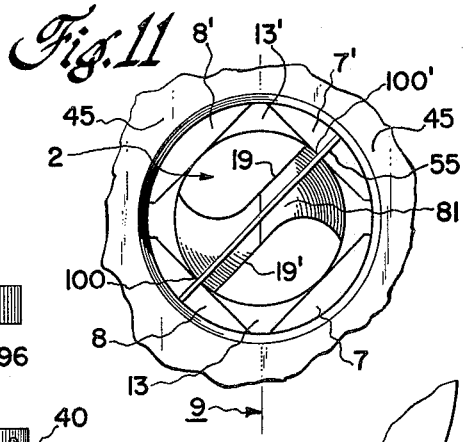
Fig. 11
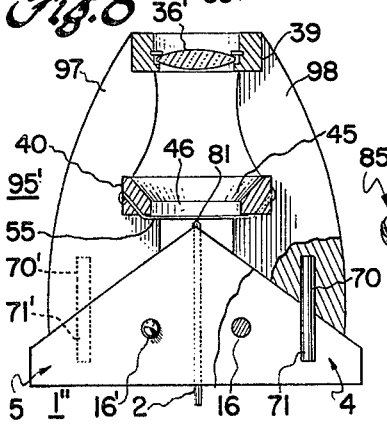
Fig. 8
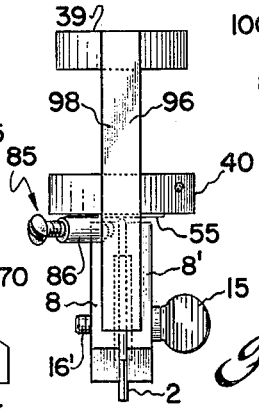
Fig 9
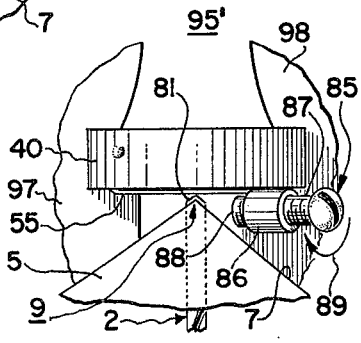
Fig. 12

TWIST DRILL SHARPENING APPARATUS

BACKGROUND

A survey of all patents relating to twist drill sharpening apparatus, that were selected during applicant's preliminary novelty search at the U.S. Patent Office will reveal a number of devices designed to serve several purposes. Some of these devices are attempts to develop a portable, convenient, and relatively inexpensive sharpening device, but it appears that they have not accomplished that purpose to the satisfaction of the user, for such devices do not appear to be on the market now. Even in the most recent patent found, U.S. Pat. No. 3,698,140, issued Oct. 17, 1972, the device requires a portable electric drill and is not too convenient to hold. The twist drill is held in a chuck holder, with separate holders for different size drills. The alignment of the twist drill cutting edges in relation to the circular sharpening wheel is not very precise. In fact, the description does not go into much detail on that aspect.

Prior attempts to build a suitable device have gone back to at least 1883. The twist drill sharpening apparatus shown in U.S. Pat. No. 288,069 used a motor driven set of emery wheels arranged with inclined sharpening faces. A twist drill was held in a holder and extended therefrom to have both cutting edges sharpened at once. This arrangment required machinery that many craftsmen do not have. It would not be convenient even for the professional craftsman who wants to sharpen his drills while on a job away from his shop.

In 1886 another device described in U.S. Pat. No. 352,789 used a grinding wheel or grinder and a sliding guide or tablerest positioned above the wheel and guide blocks to hold the implement to be sharpened. Each of the guide blocks appear to have a guide piece that mates with the platform to hold the block and guide its movement. The guide block is described as being slidable along the platform and the tool sharpened by pressing it against the grinding wheel. In this embodiment the twist drill is not guided except by hand pressure and the alignment with the twist drill cutting edge and the grinding wheel is uncertain. Further, the alignment of the twist drill in the guide block does not appear to be described in detail. All these factors determine the quality of the sharpening and it is apparent that there is room for improvement. One of the embodiments (FIG. 5 and related Figures) is designed to hold a twist drill. An index plate is used together with guides to adjust the twist drill by a very complex series of steps. It is apparent that this device is very complicated to build and use.

In U.S. Pat. No. 1,576,313 issued in 1926 an assembly of a motor driven grinding wheel and tool holder is used to sharpen a twist drill. The drill is held in a carrier, apparently by hand pressure and a block is adjustably arranged to position the twist drill end. A straight edge part of the carrier is used to aim the twist drill cutting edge. A pedestal supports the twist drill carrier at an angle to the grinding wheel, corresponding to the angle between the cutting edges and the axis of the drill. An embodiment shown in FIGS. 4 through 6 involves a separate apparatus to position the twist drill in the carrier before it is placed on the sharpening pedestal. A magnifying glass is used to focus on the straight edge and aim the twist drill cutting edge. It is apparent that this sharpening device requires precise mechanical fittings and adjustments. Also, the twist drill must be moved to separate pedestals. Also, the twist drill carrier must be moved to a new position for the other cutting edge to be sharpened. It would be desirable if some of these requirements could be avoided or minimized, to have a more simplified twist drill sharpening device that can be hand held, is portable, and is relatively easy to operate.

Some of the hand-held twist drill sharpening devices have required re-positioning the twist drill to sharpen both cutting edges, as in U.S. Pat. No. 2,408,544, or use of a carrier that is hand manipulated against a grinding wheel, as described in U.S. Pat. No. 2,821,820. One of the features that is not provided is a simplified and reliable way to align and hold the twist drill relative to sharpening surfaces that can guide the sharpening tool.

Articles have described the use of optical devices, like a hand magnifier with indices to measure drill wear and the cutting edge angle. These articles found in the search are "Design News", page 12, Apr. 28, 1958, Volume 13, No. 9, and a brochure dated in 1959 by Steptool Corporation, 3613 East Olympic Boulevard, Los Angeles, Calif. Each of these articles were found in the Patent Office search files, in the Examiners' offices in Class 51, Sub-class 219.

OBJECTS AND SUMMARY OF INVENTION

The prior devices for sharpening twist drills have many advantages for use in large machine shops by machinists, and other places where power drills and motor driven sharpening devices are available. The typical home craftsman does not own these special machines. The professional craftsman finds that on occasions a twist drill needs sharpening right away and other, more simplified sharpening devices are needed. The typical home craftsman is not interested in learning how to operate a complex sharpening device, and such a person will not pay a lot of money for a twist drill sharpener. Instead, this typical home craftsman uses a drill until it is dull and then continues to use it or throws it away and buys another one. The resultant poor work on such occasions and the unnecessary cost and waste are obvious.

It is one object of the present invention to provide a twist drill sharpening device that does not require sophisticated or expensive machinery.

It is a further object of the present invention to provide a portable twist drill sharpening device that can be carried with a craftsman on a job to sharpen a twist drill right away.

It is another object of the present invention to provide a twist drill sharpening device that can be held in a person's hand and conveniently used.

It is a further object of the present invention to provide a twist drill sharpening device that is relatively simple to operate and compatable with what the typical home craftsman can use and afford.

These and other objects of the present invention are accomplished by providing in one embodiment a twist drill sharpening apparatus with two V-shaped clamping members. Each of the clamping members has opposite sides. Adjacent end faces on the clamping pieces are flat and come together at the apex of the V to form a straight roof line. There is a means on the members to maintain the twist drill in alignment at right angle to the roof line in a plane formed by the roof line and a line bisecting equally the angle of the V, when the twist drill is clamped between one side of each member. The twist drill extends out from the apex for the twist drill cutting edges to be sharpened. The member faces that are adjacent to each other are combined in the same plane so that a sharpening tool having a flat sharpening surface moved along each of the combined faces can sharpen the exposed, respective twist drill cutting edges.

The alignment of the twist drill cutting edges is provided by a portable, hand-held optical indicating device that comprises a magnifier lens and a frame supporting the lens and defining a viewing area for the lens. A narrow width, straight index member extends in a plane across the viewing area. The magnifier lens is arranged to focus on the plane of the index member. The indicating device is separable from the clamping members and includes means to align the index member at a predetermined angle with respect to the roof line. The predetermined angle is at the position for the cutting edge of the twist drill to be sharpened by a tool having a flat sharpening surface moved along each of the combined faces. The optical indicating device is arranged so that a person can view the index member and the twist drill cutting edges as they appear in the viewing area and align one of the cutting edges with the index member and thereby place each of the cutting edges in a position to be sharpened.

Several of these features and other features of the invention in various combinations and forms include the arrangement of the optical indicating device to align the index member with the roof line. In one embodiment the indicating device incorporates also another index member that can be aligned with the roof line. In another embodiment the indicating device mounts on the clamping members and can be removed, with means provided for aligning the cutting edge index member relative to the roof line. The mounting arrangement can take several forms, including a frame that has feet that allows the indicating device to rest on the combined faces of the clamping members and serve to align the index member. In a further form the frame is provided with guide means that allows for some separation of the indicating device while maintaining the alignment of the index member and the roof line for a distance before the indicating device is completely withdrawn.

BRIEF DESCRIPTION OF THE DRAWINGS

FIG. 1 is a perspective view of one embodiment of the present invention shown holding a twist drill ready for sharpening.

FIG. 2 is one embodiment of an optical indicating means for aligning the twist drill with respect to the twist drill holders of FIGS. 1, 6, 7 and 8.

FIG. 3 is a plan view showing the optical indicating means of FIG. 2 arranged with respect to the holder of FIG. 1 with the indices properly aligned with the twist drill cutting edge and holder roof line.

FIG. 4 is an enlarged view as seen by a person looking through the magnifying lens of the optical indicating device of FIG. 2, as positioned in FIG. 3.

FIG. 5 is an elevation side view of another embodiment of an optical indicating device.

FIG. 6 is a perspective view of a modified form of twist drill holder embodiment in combination with the optical indicating device of FIG. 5 mounted thereon to align a twist drill.

FIG. 7 is a perspective view showing several sizes of holders of the embodiment of FIG. 1, each holder covering a range of drill diameters.

FIG. 8 is an elevation side view, partially in section, and with part removed for clarity, of a modified form of the optical indicating device shown in FIG. 5, mounted on a holder of the type show in FIG. 1, with guide posts to maintain alignment of the cutting edge index.

FIG. 9 is an elevation end view of the embodiment of FIG. 8.

FIG. 10 is a plan view of the embodiment of FIG. 8.

FIG. 11 is an enlarged view as seen by a person looking through the magnifier lens of the optical indicating device of FIG. 8, with the index properly aligned with the twist drill cutting edge and the holder roof line as shown in FIG. 10.

FIG. 12 is an enlarged side elevation view of a part of the optical indicating device of FIG. 8.

DETAILED DESCRIPTION

The typical home craftsman needs a twist drill sharpener that is portable, hand held, simple to use, and relatively inexpensive. Determining the compromises that can be made to reach these goals have involved considerable development by the present inventor. First, it was decided to use a sharpening tool that most home craftsman and tool users have, a sharpening tool with a flat sharpening surface that can be hand held, such as a flat abrasive stone or fine cutting file. The twist drill should be clamped in a holder that is convenient to open and close and does not require movement of the twist drill after initial alignment. Each cutting edge of the twist drill should be in position for sharpening without further movement. Further, the holder should provide a surface to guide the sharpening tool so that it can be moved conveniently with one hand and the holder held in the other hand while the twist drill is maintained in the proper alignment relative to each of the guide surfaces. A further important need is to have a simple way of aligning the twist drill in the holder. An indicating means is aligned with the holder to position an index member in proper relation to a feature of the holder that serves many purposes — the apex of the V-shaped clamping members that forms the roof line through which the twist drill extends.

With the above brief introduction of some of the features and advantages of the present invention, it would be stated that the present invention can be constructed in several apparatus forms and combinations without departing from the invention teaching. What applicant will now describe are several preferred embodiments of the present invention.

The embodiment of FIG. 1 comprises a holder 1 for the twist drill 2 with its front end extending from the top of holder 1 and the bottom end extending out below holder 1. Holder 1 is made up of two clamping members 3 and 4 that have flat, parallel sides 5 and 6, and 5' and 6', respectively. The upper end of each of clamping members 3 and 4 have flat faces 7 and 8, and 7' and 8', respectively that are formed at an angle $\alpha$ as a V-shaped end where the planes of the faces 7 and 8 form a roof line 9 and the faces 7' and 8' form a roof line 9'. The bottom end of each of clamping members 3 and 4 has parallel, flat sides 10 and 11, and 10' and 11', respectively (See FIG. 3 for side 11'). Each of clamping members 3 and 4 have a flat bottom face 12 and 12', respectively. Clamping members 3 and 4 can be constructed of a suitable light weight material, such as aluminum of a hardened form to standup to wear and continued use. It is apparent that clamping members 3 and 4 are identical in size and construction for the features described so far, so they can be produced at low cost by die casting.

Holder 1 has provision to position twist drill 2 that is held between clamping members 3 and 4. V-shaped channels 13 and 13′ (Shown clearer in FIG. 4) are cut from the roof lines 9 and 9′, respectively, in sides 6 and 6′ and extend uniformily straight down the respective side 6 and 6′ to the bottom face 12 and 12′, respectively. Each of channels 13 and 13′ has an apex 14 and 14′, respectively, forming a line that extends straight down its respective side 6 and 6′ bisecting equally the angle $\alpha$ formed by the respective end faces 7 and 8, and 7′ and 8′.

The clamping members 3 and 4 are fastened together to hold twist drill 2 therebetween in channels 13 and 13′, as shown more clearly in FIG. 4. Fasteners 15 and 15′ of identical construction, preferably made of metal, have convenient finger grasping ends 17 and 17′, respectively, and a threaded bolt extension 16 and 16′, respectively (See FIGS. 8 and 9 for a clear picture of the bolt portion). Fasteners 15 and 15′ pass freely through holes in clamping member 3 and the bolt extensions 16 and 16′ engage matching threaded openings in clamping member 4. Fasteners 15 and 15′ are spaced equal distant on either side of twist drill 2. At the same time fasteners 15 and 15′ hold the clamping members 3 and 4 together in spaced relation with a uniform gap 18 therebetween, and positioning the clamping member adjacent faces 7 and 7′, and 8 and 8′ in the same respective planes. The combined faces 7 and 7′, and 8 and 8′ respectively form a surface for guiding a sharpening tool. The roof lines 9 and 9′ are in a straight line and are referred to hereinafter collectively as roof line 9 of holder 1.

Twist drill 2 at the top end has cutting edges 19 and 19′ (FIG. 4) that must be kept sharp. Prior sharpening devices have used various mechanisms to match the movement of the sharpening tool to the geometrical configuration of the twist drill cutting face. However, to achieve a more simplified device, this invention makes a compromise and assumption that most craftsmen have available, or can buy at a relatively small price a sharpening tool with a flat sharpening surface. One example is sharpening stone 20 having a flat abrasive lower surface 21. If a twist drill needs sharpening on the spot, it can be sharpened for effective use in holder 1 by a flat sharpening surface, when the cutting edges 19 and 19′ are properly aligned with respect to the roof line 9 and the twist drill 2 is properly extended from roof line 9 relative to the clamping member combined faces 7 and 7′, 8 and 8′. Sharpening stone 20 is moved back and forth, in the directions shown by arrows 23, along combined faces 8 and 8′ to sharpen cutting edge 19 and along combined faces 7 and 7′ to sharpen cutting edge 19′.

The alignment of the cutting edges 19 and 19′ is critical. The predetermined angle $\theta$ (FIG. 4) formed by intersection of the roof line 9 and the cutting edge 19′, in a plane parallel to the plane of clamping member bottom faces 12 and 12′, is used, so that a person can conveniently align twist drill 2. An indicating device is used to align an index positioned at the predetermined angle $\theta$ relative to the roof line 9, so that a person can adjust the angular position of twist drill 2 to align the cutting edges 19 and 19′ with the index. The predetermined angle varies with the type of twist drill. Generally, an angle of 45° has been found suitable.

The optical indicating device 30 of FIG. 2 is an embodiment that includes a metal frame 31 with an upper arm 32 pivotally mounted by joint 33, a connecting piece 34, and a lower arm 35. A magnifier lens 36 is mounted in upper arm 32. Lower arm 35 has a square opening 29 defining a viewing area. Up to this point what has been described is a conventional magnifier frame used to enlarge objects appearing in opening 29 when frame 31 is rested on a surface. What applicant has added is a tightly stretched index wire 37 that extends at right angle to the sides of rectangular opening 29 and is soldered or fastened by a screw at each end. A second index wire 38 is added, extending tightly from corner-to-corner of the square opening 29 and is fastened by a suitable means at each end. The angle of intersection of indices 37 and 38 in a plane parallel to the flat face of lower arm 35 is angle $\theta$, the predetermined angle mentioned above.

When the indicating device frame 30 is held over holder 1, as shown in FIG. 3 and 4, index wire 37 is aligned right over roof line 9. The magnifier lens 36 gives a person a clear view (FIG. 4) of indices 37 and 38, since lens 36 is focused on these indices. The upper end of twist drill 2 is visible through lens 36, and while holder 1 loosely clamps twist drill 2 it can be turned to align the cutting edge 19 parallel with index wire 38, while maintaining the alignment of index wire 37 with roof line 9. The result of this positioning is that both cutting edges 19 and 19′ are properly aligned. While the cutting edge is not always straight, as shown, the general line of the cutting can be approximated. After some experience with the sharpening device, a craftsman may off-set the cutting edge slightly from the index angle $\theta$, to obtain a particular form of sharpened twist drill. The term alignment is used herein with respect to the cutting edge index to cover these several ways to use the cutting edge index.

Once the angular alignment of twist drill 2 is accomplished, twist drill 2 is moved lengthwise, while still maintaining the angular alignment. The upper end of twist drill 2 is positioned to extend slightly above roof line 9, so that the sharpening stone 20 moved along clamping member faces 8 and 8′ can remove a small portion of twist drill back face 90, enough to sharpen the cutting edge 19. The same action takes place when sharpening stone 20 is moved along clamp faces 7 and 7′ to remove a portion of back face 90′ and sharpen cutting edge 19′. It should be noted that twist drill 2 extends out from the apex of clamping members 3 and 4, with V-channels 13 and 13′ positioning twist drill 2 properly with respect to the apex angle $\alpha$, roof line 9, and faces 7 and 7′, and 8 and 8′. The channels 13 and 13′ form a notch, when clamping members 3 and 4 are fastened together, exposing a portion of back faces 90 and 90′ below roof line 9.

While the flatly sharpened back faces 90 and 90′ do not conform to the type of sharpening obtained with more sophisticated machine shop type sharpening devices, it does a satisfactory job. It enables the craftsman to go on with his job immediately, using a sharper drill. Also, it can allow a craftsman a convenient way to sharpen a twist drill according to his own preference that may produce even a better sharpened drill for a particular job than more sophisticated sharpening machinery.

Another optical indicating device embodiment 95 is shown in FIG. 5 that is used to align twist drill 2 with respect to roof line 9. This embodiment, illustrated in FIGS. 5 and 6 can be mounted on holder 1, or on modified holders 1' of FIG. 6 or 1'' of FIG. 8. Optical indicating device 95 can be mounted on these holders to align the index for the twist drill cutting edge with respect to roof line 9. The alignment is established by the indicating device frame 96 that has legs 97 and 98 supporting an upper ring 39 and lower ring 40. Lower ring 40 has a beveled inner surface 45 that forms a circular opening 46.

The alignment of indicating device 95 is provided by legs 97 and 98 that straddle the apex and roof line 9 of holders 1, 1', or 1''. The side faces 47 48 on leg 97 are flat and in parallel planes and the side faces 49 and 50 of leg 98 are flat in the same planes of the respective sides 47 and 48. Each of legs 97 and 98 has a foot 51 and 52, respectively, that rests on the holder faces 7 and 7', and 8 and 8', respectively, to position the indicating device 95 each time it is mounted on holders 1, 1', or 1''. Feet 51 and 52 each have a flat bottom face that rests on the holder faces 7 and 7', and 8 and 8', respectively, and can be slid side-wise in either direction, as shown by arrows 53 and 54 (FIG. 6). Sliding movement of feet 51 and 52 toward or away from roof line 9 is prevented, because feet 51 and 51 are inclined to match exactly the angle the mating holder faces 7 and 7', and 8 and 8', respectively. Feet 51 and 52 thereby position indicating device 95 in a predetermined relation with respect to roof line 9, while still permitting movement of indicating device 95 along roof line 9.

The alignment or twist drill 2 is achieved by an index wire 55 stretched tightly across opening 46 in ring 40 in a plane parallel to the planes of the ring faces 43 and 44. Index wire 55 is suitably fastened at its end to form the predetermined angle with roof line 9 when indicating device 95 is mounted on holders 1, 1', or 1''. To complete the arrangement of indicating device 95, a magnifier lens 36' is mounted in upper ring 39 (FIG. 8) in a position to focus on the plane containing index wire 55 and the enlarged view seen by a person looking through lense 36' is shown in FIG. 11.

Indicating device 95 can be placed quickly on holder 1, 1' or 1'', aligning index wire 55 with respect to roof line 9. Twist drill 2 is placed in the holder and clamped loosely so it can be turned. Cutting edge 19 is aligned parallel with index wire 55, automatically aligning cutting edge 19' with respect to roof line 9. The lengthwise position of twist drill 2 is properly set by movement of twist drill 2 while still maintaining its alignment with index wire 55. Twist drill 2 is clamped firmly by adjustment of fasteners 15 and 15' and the sharpening begins, as described above, after indicating device 95 is removed.

The replacement of indicating device 95 is easy, to re-check alignment, and it is freely and easily removable to avoid obstructing the sharpening operation. The sliding movement in the directions of arrows 53 and 54 allows re-positioning the index wire 55 along roof line 9 without changing the angular relation to roof line 9. This adjustment is convenient to accommodate various diameter twist drills. As with indicating device 30, the alignment of one cutting edge aligns both cutting edges for most twist drills. Should the cutting edges not be substantially parallel, they can be individually aligned. One advantage of holders 1, 1', and 1'' is that for the usual situation, when one cutting edge is aligned and the twist drill is positioned properly lengthwise, it is ready to have each cutting edge sharpened.

Holder 1' (FIG. 6) is the same as holder 1 (FIG. 1) in general arrangement and operation, with the addition of an extended surface area to cooperate with holder faces 7 and 7', and 8 and 8'. V-shaped members 60 and 60' are fastened by suitable means to the sides 5 and 5' of clamping members 3 and 4, respectively. The upper faces 7'' and 8'' of member 60 are in the same plane as faces 7 and 8, and the upper faces 7''' and the other face (not shown) of member 60' are in the same plane as faces 7' and 8'. The extended surface area helps to minimize wear at the face edges, by providing a greater guide surface for the sharpening stone 20.

The mounting of the optical indicating device can be improved in some respects by a modification best illustrated in FIG. 8 and also shown in respect to holder 1 in FIGS. 1 and 3. A guide arrangement cooperates with the holder and indicating device to maintain alignment, even though the indicating device is moved away from the holder up to a given distance. This guided movement gives flexibility while positioning the twist drill. An embodiment showing one form of this modification is illustrated in FIG. 8, with optical indicating device 95' having all of the same parts with the same reference numbers as indicating device 95, except for the next modifications to be described below.

The movement guidance is provided by posts 70 and 70' that extend out from legs 97 and 98, respectively. Each of posts 70 and 70' is cylindrical in shape and fits in a mating hole in the bottom face of feet 51 and 52, respectively. Posts 70 and 70' have their longitudinal axes parallel to each other and parallel to the plane containing holder side faces 10, 10', 11, and 11'. Posts 70 and 70' can be fitted to wedge into the feet holes, or a fastener such as a screw is used to secure them in their respective legs.

The guiding relation is achieved by posts 70 and 70' fitting into holes 71 and 71' in any one of holders 1, 1', or 1'' (See FIGS. 1 and 3 initially). Posts 70 and 70' slide freely into and out of holes 71 and 71' respectively, without appreciable lateral movement. Some lateral movement is present due to the way the holes are formed in the illustrated embodiment, but they can be formed other ways so that there is no lateral movement. In the embodiment of FIG. 8, to form holes 71 and 71' the clamping members 3 and 4 are firmly clamped together in perfect alignment in a vise and a hole is drilled that has its axis at the interface between the clamping members 3 and 4 and at distances corresponding to the spacing of posts 70 and 70', to receive them in the manner mentioned above. Since clamping members 3 and 4, when twist drill 2 is held, are spaced apart by gap 18, there is some small side-wise laterial movement, but there is no appreciable movement toward or away from roof line 9. By simply pressing the indicating device against one of the clamping members 3 or 4, posts 70 and 70' are exactly positioned, so that index wire 55 is at the predetermined angle relative to roof line 9.

It is apparent that guide posts 70 and 70' in cooperation with holes 71 and 71' add further convenience to the use of the sharpening device. They prevent the indicating device 95' from falling off accidently. The free movement away from holder 1'' over a limited distance, while maintaining alignment of the index wire 55 is very helpful while installing the twist drill or repositioning it. There is free movement away from holder 1'' for convenient removal of indicating device 95' after alignment of twist drill 2, so the sharpening can begin without any unnecessary further steps, like loosening fasteners. In other forms of guide arrangements the holes can be of various configurations to mate with posts of the same shape. The holes for the posts can be in only one of the clamping members or one in each clamping member and still perform the same general functions. Various other guide arrangements are apparent that perform these general functions of allowing free separation while maintaining the proper alignment of index wire 55 relative to roof line 9 for a small distance as the indicating device is removed.

The guide post arrangement on indicating device 95' can be used to accommodate different size holders. Holders 1''', 1'''', and 1''''' in FIG. 7 are designed to fit different size drills. These holders have the same general shape, but they are different sizes. In each of holders 1''', 1'''', and 1''''' the spacing, as represented by line 80, between roof line 9''', 9'''', and 9''''', respectively, and the center line of the post holes 71''', 71'''', and 71''''', respectively, and the spacing of the corresponding post holes (not shown) on the opposite side of the roof lines is the same. With this arrangement indicating device 95' can be mounted on each of holders 1''', 1'''', and 1'''''.

Each of the optical indicating device embodiments of FIGS. 6 and 8 have a gauge 85 that can be used to check whether the point of twist drill tip 81 is centered, a step that may or may not be desired by the craftsmen. When the optical indicating devices 95 or 95' are used in the manner described above, gauge 85 is not involved, as it is withdrawn from any contact with holders 1' or 1''. Gauge 85 comprises an internally threaded support ring 86 fastened to the lower face of ring 40. A machine screw 87 is screwed into support ring 86 and its end 88 extends out the other end of support ring 86. When aligning twist drill 2, screw 87 is rotated counterclockwise, to withdraw it from any contact with clamping member face 7, as shown in FIG. 12.

After twist drill 2 is sharpened, it can be checked to see if the point of drill tip 81 is centered, by using either optical indicating devices 95 or 95'. Twist drill 2 is removed from the holder and placed under ring 40 with the point of tip 81 aligned with index wire 55. Screw 87 is screwed clockwise, in the direction shown by arrow 89, to move it inward against land 100, at the side of the cutting edge 19' (FIG. 11). Twist drill 2 is rotated 180 degrees while maintaining the point-index alignment and placed against the opposite land 100', without any adjustment of screw 87. A person looking through lense 36' will be able to see if the point of twist drill tip 81 is aligned under index wire 55. If it is so aligned, the point is centered on tip 81. If it is not so aligned, the point is not centered and twist drill 2 can be sharpened further until the point of tip 81 is centered. After the twist drill point center is checked, screw 87 is withdrawn again, so the optical indicating devices 95 and 95' can be used to align a twist drill. Gauge 85 can be omitted, when desired, if no point center check is to be used, or should some other checking device be available.

While the present invention has been described with reference to preferred embodiments, it should be stressed that it can be incorporated in various other forms and combinations, without departing from the invention scope as defined in the following claims.

I claim:

1. A twist drill sharpening apparatus for hand use and portable comprising a twist drill holder means, said twist drill holder means comprising adjacent flat faces at an angle to each other and forming a V-shaped member having a straight roof line at the intersection of said faces, means for removably fastening the twist drill to said holder means in alignment at right angle to said roof line in a plane formed by said roof line and a line bisecting equally the angle formed by said faces, to position the drill with the cutting edges extending out from said faces to expose the cutting edges for sharpening by a sharpening means having a flat sharpening surface that is moved along each of said faces, means for indicating the orientation of the twist drill in said drill holder means to place each of the twist drill cutting edges in a desired position relative to the plane of said holder means faces, said indicating means being arranged to align said cutting edges at a predetermined angle with respect to said roof line, said indicating means comprising an index that can be aligned with a cutting edge of a twist drill, means on said indicating means for alignment with said roof line, to position said index at a predetermined angle with respect to said roof line, said index being oriented to position a twist drill at said predetermined angle that enables a sharpening means with a flat sharpening surface moving along each of said flat faces to sharpen each of the twist drill cutting edges.

2. The apparatus as described in claim 1, where in said indicating means comprises means to removably mount said indicating means on said holder means and to align said index with respect to said roof line.

3. The apparatus as described in claim 1, wherein said indicating means comprises a removable frame that supports said index on said flat faces, said frame support on each of said flat faces comprising a foot that rests on said respective holder means flat face, the bottom surface of each of said feet being shaped to mate with the angle of the respective flat face and position said index at said predetermined angle relative to said roof line.

4. The apparatus as described in claim 1, wherein said indicating means comprises a frame that supports said index on said flat faces, said frame support on each of said flat faces comprising a foot that rests on said respective holder flat face, means for removably mounting said frame on said holder means to orient said index relative to said roof line at said predetermined angle, said mounting means allowing said frame and holder means to separate freely in a direction along the held twist drill length and restricting movement along said flat faces to maintain alignment of said index with said roof line.

5. The apparatus as described in claim 4, wherein said mounting means permits free separation of said frame from said holder means along the twist drill length to move said index toward and away from the end of the twist drill while maintaining said index alignment with said roof line, to facilitate placement and orientation of the twist drill.

6. A twist drill sharpening apparatus for hand use and portable, comprising a twist drill holding means, said holding means comprising two V-shaped members, each of said members having opposite sides, adjacent end faces on each of said members that are flat and come together at the apex of said V to form a straight roof line, means on said holding means for maintaining the twist drill in alignment at right angle to said roof line with a plane formed by said roof line and a line bisecting equally the angle of the V when said holding means members are clamped together and to permit the twist drill to extend out from said apex in a postion for the twist drill cutting edges to be sharpened, means for clamping said members together with one side of each of said members facing each other to hold a twist drill in said alignment, said member faces that are adjacent each other being combined in the same plane, so that a sharpening tool having a flat sharpening surface moved along each of said combined faces can sharpen the exposed, respective twist drill cutting edges, an optical indicating device comprising a magnifier lens, a frame supporting said lens and having a viewing area, and a narrow width, straight index member extending in a plane across said viewing area, said magnifier lens being arranged to focus on the plane of said index member, said optical indicating device being portable, hand held, and separable from said twist drill holding means, said optical indicating device comprising means for alignment with said roof line to align said index member at a predetermined angle with respect to said holding means member roof line, said predetermined angle being at the position for the cutting edge of the twist drill to be located to sharpen said twist drill cutting edge by a sharpening tool having a flat sharpening surface moved along each of said member combined faces, said optical indicating device being arranged so that a person can view said index member and the twist drill cutting edges as they appear in said viewing area and align one of said cutting edges with said index member and thereby place each of said cutting edges in a position to be sharpened.

7. Apparatus as described in claim 6, wherein said optical indicating devices comprises a second narrow, elongated index member extending in a plane across said frame viewing area forming an angle with respect to the other index member, said second index member angle being such that when said second index member is aligned with said holding means member roof line the other said index member is at said predetermined angle with respect to said roof line as viewed in said magnifier lens, said optical indicating device being convenient for holding in a person's one hand and not requiring the use of the other hand so that the other hand can be used to grasp said holding means and move the twist drill into alignment.

8. Apparatus as described in claim 6, wherein said optical indicating device alignment means comprises legs on said frame that project outward and are arranged to mount removably said indicating device on said twist drill holding means, said legs being arranged to position said index member and lens adjacent the apex of said holding means members so that said lens and said index are positioned for a person to view the cutting edges of the twist drill held between said holding means members, and said index member is positioned by the mounting of said legs on said holder means members to align said index member at said predetermined angle with respect to said holding means member roof line and at a position adjacent the twist drill to place the twist drill cutting edges in focus for a person aligning said member index with one of the twist drill cutting edges.

9. Apparatus as described in claim 6 wherein said indicating device comprises a means for checking the centering of the twist drill point, said checking means comprising an adjustable means mounted on said frame to be positioned against one land of the twist drill with the twist drill point in alignment with the index member and to position the opposite twist drill land against said adjustable means, so that a person viewing said index member and the point through said magnifier lens can see if the point is aligned with said index member.

10. A twist drill sharpening apparatus for hand use and portable, comprising a twist drill holding means, said holding means comprising two V-shaped members, each of said members having opposite sides and adjacent end faces on each of said members that are flat and come together at the apex of the V to form a straight roof line, a channel extending from said apex on one side of each of said members and on a line bisecting equally the angle formed by said end faces, each of said channels being provided to accommodate twist drills of various sizes and to align the twist drill that is clamped between said one sides of said members and to expose the cutting edge of a twist drill at the apex of said member faces, means for releasably clamping said members together with said members one sides facing each other to hold a twist drill between said members and positioned in said channels with the cutting edges of the twist drill being exposed at the apex of said members by the member portion cut away at said apex by said channels, said member faces that are adjacent each other being combined in the same plane, so that a sharpening tool having a flat sharpening surface moved along each of said combined faces can sharpen the exposed twist drill cutting edge, an indicating device comprising a magnifier lens, a frame for carrying said magnifier lens, said frame having an opening, a narrow width, straight index member extending across said opening and fixed to said frame in a plane parallel to said opening, said magnifier being arranged to focus on the plane of said index member, said indicating device being portable, hand held, and separable from said twist drill holding means, said optical device comprising means for alignment with said roof line to align said index member at a predetermined angle with respect to said holding means member roof line, said predetermined angle being at the position for the cutting edge of a twist drill to be located to sharpen twist drill cutting edge by a sharpening tool having a flat sharpening surface moved along each of said member combined faces, said optical device being arranged so that a person can view said index member and the twist drill cutting edges, to align one of said cutting edges with said index member and thereby place each of said cutting edges in a position to be sharpened.

11. A twist drill sharpening apparatus for hand use and portable, comprising a twist drill holding means, said holding means comprising two V-shaped members, each of said members having opposite sides, adjacent end faces on each of said members that are flat and come together at the apex of said V to form a straight roof line, means on said holding means for maintaining the twist drill in alignment at right angle to said roof line with a plane formed by said roof line and a line bisecting equally the angle of the V when said holding means members are clamped together and to permit the twist drill to extend out from said apex in a postion for the twist drill cutting edges to be sharpened, means for clamping said members together with one side of each of said members facing each other to hold a twist drill in said alignment, said member faces that are adjacent each other being combined in the same plane, so that a sharpening tool having a flat sharpening surface moved along each of said combined faces can sharpen the exposed, respective twist drill cutting edges, an optical indicating device comprising a magnifier lens, a frame supporting said lens and having a viewing area, and a narrow width, straight index member extending in a plane across said viewing area, said magnifier lens being arranged to focus on the plane of said index member, said optical indicating device being portable, hand held, and separable from said twist drill holding means, said optical indicating device comprising means to align said index member at a predetermined angle with respect to said holding means member roof line, said predetermined angle being at the position for the cutting edge of the twist drill to be located to sharpen said twist drill cutting edge by a sharpening tool having a flat sharpening surface moved along each of said member combined faces, said optical indicating device being arranged so that a person can view said index member and the twist drill cutting edges as they appear in said viewing area and align one of said cutting edges with said index member and thereby place each of said cutting edges in a position to be sharpened, said optical indicating device frame comprising legs that project outward and are arranged to mount removably said indicating device on said twist drill holding means, said legs being arranged to position said index member and lens adjacent the apex of said holding means members so that said lens and said index are positioned for a person to view the cutting edges of the twist drill held between said holding means members, and said index member is positioned by the mounting of said legs on said holder means members to align said index member at said predetermined angle with respect to said holding means member roof line and at a position adjacent the twist drill to place the twist drill cutting edges in focus for a person aligning said member index with one of the twist drill cutting edges, said legs straddling said holding means member apex and each of said legs has a foot that rests on said holding means member and is slidable on said respective faces to move across said respective faces and not significantly movable toward or away from said apex, each of said feet being shaped to mate with the mating holding means member face to prevent significant movement of said legs along said holding member faces toward or away from said holding means member apex and aligning said frame on said holding means to position said index member at said predetermined angle with respect to said roof line and at a position adjacent the held twist drill to place said index member and the twist drill cutting edges in focus for a person aligning said index member with one of the twist drill cutting edges, said index being movable by said sliding relation to align said index member with the twist drill cutting edge for different twist drill sizes, and said frame being of a convenient size to place said frame on said holding means and remove said frame with one hand and to slide said frame conveniently as a person views said index member and twist drill cutting edge through said lens to align said index member with one of said twist drill cutting edges.

12. A twist drill sharpening apparatus for hand use and portable, comprising a twist drill holding means, said holding means comprising two V-shaped members, each of said members having opposite sides, adjacent end faces on each of said members that are flat and come together at the apex of said V to form a straight roof line, means on said holding means for maintaining the twist drill in alignment at right angle to said roof line with a plane formed by said roof line and a line bisecting equally the angle of the V when said holding means members are clamped together and to permit the twist drill to extend out from said apex in a position for the twist drill cutting edges to be sharpened, means for clamping said members together with one side of each of said members facing each other to hold a twist drill in said alignment, said member faces that are adjacent each other being combined in the same plane, so that a sharpening tool having a flat sharpening surface moved along each of said combined faces can sharpen the exposed, respective twist drill cutting edges, an optical indicating device comprising a magnifier lens, a frame supporting said lens and having a viewing area, and a narrow width, straight index member extending in a plane across said viewing area, said magnifier lens being arranged to focus on the plane of said index member, said optical indicating device being portable, hand held, and separable from said twist drill holding means, said optical indicating device comprising means to align said index member at a predetermined angle with respect to said holding means member roof line, said predetermined angle being at the position for the cutting edge of the twist drill to be located to sharpen said twist drill cutting edge by a sharpening tool having a flat sharpening surface moved along each of said member combined faces, said optical indicating device being arranged so that a person can view said index member and the twist drill cutting edges as they appear in said viewing area and align one of said cutting edges with said index member and thereby place each of said cutting edges in a position to be sharpened, said optical indicating device frame comprising legs that project outward and are arranged to mount removably said indicating device on said twist drill holding means, said legs being arranged to position said index member and lens adjacent the apex of said holding means members so that said lens and said index are positioned for a person to view the cutting edges of the twist drill held between said holding means members, and said index member is positioned by the mounting of said legs on said holder means members to align said index member at said predetermined angle with respect to said holding means member roof line and at a position adjacent the twist drill to place the twist drill cutting edges in focus for a person aligning said member index with one of the twist drill cutting edges, said legs straddling said apex and each of said legs having a foot that rests on respective said holding means members adjacent faces, each of said feet being shaped to mate with the respective holding means member face to prevent significant movement along said holding means member faces toward or away from said holding means members apex and aligning said frame on said holding means to position said index member at said predetermined angle with respect to said roof line and at a position adjacent the held twist drill to place said index member and the twist drill edges in focus for a person aligning said index member with one of the twist drill cutting edges, means for guiding said frame and permitting movement toward and away from said holding means member apex along the length of the twist drill for a distance that accommodates different twist drill extensions from said holding means member apex, so that said frame can be moved, by a person holding said frame in one hand, toward and away from the twist drill with the guide means maintaining the alignment of said index member with said member roof line at said predetermined angle.

* * * * *